US007159404B2

(12) United States Patent
Vitantonio et al.

(10) Patent No.: US 7,159,404 B2
(45) Date of Patent: Jan. 9, 2007

(54) SYSTEM AND METHOD FOR STORING A PRODUCT IN A THERMALLY STABILIZED STATE

(75) Inventors: Marc L. Vitantonio, South Russell, OH (US); Jeffrey M. Kalman, Cleveland Heights, OH (US)

(73) Assignee: Country Pure Foods, LLC, Akron, OH (US)

( * ) Notice: Subject to any disclaimer, the term of this patent is extended or adjusted under 35 U.S.C. 154(b) by 43 days.

(21) Appl. No.: 11/138,139

(22) Filed: May 26, 2005

(65) Prior Publication Data

US 2006/0272336 A1 Dec. 7, 2006

(51) Int. Cl.
*F25B 21/02* (2006.01)

(52) U.S. Cl. ..... 62/3.2; 62/115; 62/389

(58) Field of Classification Search ..... 62/3.2, 62/3.3, 3.6, 3.64, 3.7, 79, 389, 393, 3.4, 115; 165/80.4; 361/702, 721; 174/15.1; 147/15.1
See application file for complete search history.

(56) References Cited

U.S. PATENT DOCUMENTS

| | | | | |
|---|---|---|---|---|
| 3,146,600 | A | 9/1964 | Cox | |
| 4,320,626 | A * | 3/1982 | Donnelly | 62/3.64 |
| 4,671,070 | A | 6/1987 | Rudick | |
| 4,738,113 | A | 4/1988 | Rudick | |
| 4,845,957 | A | 7/1989 | Richardson | |
| 4,898,004 | A | 2/1990 | Richardson | |
| 4,914,920 | A | 4/1990 | Carnagie et al. | |
| 5,315,830 | A | 5/1994 | Doke et al. | |
| 5,357,426 | A * | 10/1994 | Morita et al. | 700/90 |
| 5,367,879 | A | 11/1994 | Doke et al. | |
| 5,501,076 | A | 3/1996 | Sharp, III et al. | |
| 5,505,054 | A | 4/1996 | Loibl et al. | |
| 5,544,489 | A | 8/1996 | Moren | |
| 5,572,872 | A | 11/1996 | Hlavacek | |
| 5,584,187 | A | 12/1996 | Whaley | |
| 5,704,223 | A * | 1/1998 | MacPherson et al. | 62/3.62 |
| 5,860,280 | A * | 1/1999 | Recine, Sr. et al. | 62/3.64 |
| 5,878,579 | A | 3/1999 | Boyer, III | |
| 5,918,468 | A | 7/1999 | Cassells et al. | |
| 5,970,719 | A | 10/1999 | Merritt | |
| 6,003,318 | A * | 12/1999 | Busick et al. | 62/3.64 |
| 6,026,988 | A * | 2/2000 | Teetsel et al. | 222/88 |
| 6,082,114 | A | 7/2000 | Leonoff | |
| 6,119,464 | A * | 9/2000 | Nakayama et al. | 62/59 |
| 6,234,345 | B1 | 5/2001 | Minh et al. | |
| 6,282,906 | B1 | 9/2001 | Cauchy | |

(Continued)

FOREIGN PATENT DOCUMENTS

JP 11-118313 A * 4/1999

(Continued)

*Primary Examiner*—Mohammad M. Ali
(74) *Attorney, Agent, or Firm*—Hahn Loeser & Parks LLP

(57) ABSTRACT

A system and method for storing a product in a thermally stabilized state is disclosed. The system includes a thermally-conductive structure having at least an enclosed volume and an open section. The open section is configured to store at least one unit of the product as the product is exposed to ambient air. The system also includes a thermally-conductive fluid sealed within the enclosed volume and being in thermal contact with the enclosed volume. The system further includes at least one thermo-electric device and at least one thermally-conductive probe extending from the at least one thermo-electric device and into the fluid. The probe provides a thermally-conductive path between the fluid and the thermo-electric device.

50 Claims, 9 Drawing Sheets

U.S. PATENT DOCUMENTS

| | | | | |
|---|---|---|---|---|
| 6,370,883 | B1 * | 4/2002 | Kugel | 62/3.64 |
| 6,370,884 | B1 * | 4/2002 | Kelada | 62/3.64 |
| 6,449,958 | B1 | 9/2002 | Foye | |
| 6,477,855 | B1 * | 11/2002 | Findley et al. | 62/434 |
| 6,508,070 | B1 | 1/2003 | Palmer | |
| 6,532,157 | B1 * | 3/2003 | Glenn et al. | 361/767 |
| 6,640,551 | B1 | 11/2003 | Slone et al. | |
| 6,662,574 | B1 | 12/2003 | Loibl et al. | |
| 6,805,774 | B1 * | 10/2004 | Dableh | 203/1 |
| 6,918,257 | B1 | 7/2005 | Slone et al. | |
| 6,942,018 | B1 * | 9/2005 | Goodson et al. | 165/80.4 |
| 2004/0068992 | A1 | 4/2004 | Cauchy | |
| 2004/0112069 | A1 | 6/2004 | Loibl et al. | |
| 2005/0010904 | A1 | 1/2005 | Morioka | |

FOREIGN PATENT DOCUMENTS

| | | |
|---|---|---|
| JP | 2000028248 | 1/2000 |

* cited by examiner

SYSTEM AND METHOD FOR STORING A PRODUCT IN A THERMALLY STABILIZED STATE

TECHNICAL FIELD

Certain embodiments of the present invention relate to product containers. More particularly, certain embodiments of the present invention relate to a product container and methods for storing a product in a thermally stabilized state using a thermo-electric device.

CROSS-REFERENCE TO RELATED APPLICATIONS/INCORPORATION BY REFERENCE

U.S. Pat. No. 5,544,489 issued to Moren on Aug. 13, 1996 is incorporated by reference herein in its entirety.

BACKGROUND OF THE INVENTION

Many times it is desirable to keep a perishable or non-perishable product cooled or warmed, for example, in a store before purchase, in order to extend the shelf life of the product and because consumers want to consume the product in a cooled or heated state. Such products may include, for example, cartons or bottles of juice, milk, water, or other liquids. Traditional refrigeration units and ovens are often used to keep the products cooled or warmed. Such traditional units are often complex systems that include having to pump fluids or gases throughout the system and that include using complex compressors and heat exchangers. These units often consume relatively large amounts of power to provide cooling or heating of the products.

Often these refrigeration and heating units are enclosed structures having doors or lids that must be opened by a customer in order to pull the product out of the unit. Also, many times, these refrigeration and heating units are large and are located towards the back of a store where there is access to higher power sources.

It is desirable to provide a system and method for storing a product in a thermally stabilized state (e.g., a cooled state or a heated state) at a check-out counter of a store such that a potential customer may simply reach and pull a unit of the product out of the system without having to open a door or a lid, and without the product having to be dispensed.

Further limitations and disadvantages of conventional, traditional, and proposed approaches will become apparent to one of skill in the art, through comparison of such systems and methods with the present invention as set forth in the remainder of the present application with reference to the drawings.

BRIEF SUMMARY OF THE INVENTION

An embodiment of the present invention comprises a system for storing a product in a thermally stabilized state. The system comprises a thermally-conductive structure having at least an enclosed volume and an open section. The open section is configured to store at least one unit of the product as the product is exposed to ambient air. The system further comprises a thermally-conductive fluid sealed within the enclosed volume and being in thermal contact with the enclosed volume. The system also comprises at least one thermo-electric device and at least one thermally-conductive probe extending from the at least one thermo-electric device and into the fluid. The probe provides a thermally-conductive path between the fluid and the thermo-electric device.

Another embodiment of the present invention comprises a first method for thermally stabilizing a product. The method includes pre-conditioning a thermally-conductive fluid to a first predefined temperature range using at least one thermo-electric device. The method further comprises pre-conditioning a thermally-conductive structure to a second predefined temperature range using the pre-conditioned fluid. The method also includes pre-conditioning a product to a third predefined temperature range using an external pre-conditioning unit. The method further includes placing the pre-conditioned product into a permanently open section of the thermally-conductive structure such that the product is in thermal contact with the thermally-conductive structure and is thermally stabilized to within the third predefined temperature range when exposed to ambient air.

A further embodiment of the present invention comprises a second method for thermally stabilizing a product. The method comprises pre-conditioning a container comprising at least one thermo-electric device, a thermally-conductive fluid, and a thermally-conductive structure to a first predefined temperature range using a first external pre-conditioning unit. The method further comprises pre-conditioning a product to a second predefined temperature range using a second external pre-conditioning unit. The method also comprises powering up the thermo-electric device such that a temperature of a probe of the thermo-electric device, which is in thermal contact with the fluid, is maintained within said first predefined temperature range. The method also comprises placing the pre-conditioned product into a permanently open section of the thermally-conductive structure such that the product is in thermal contact with the thermally-conductive structure and is thermally stabilized to within the second predefined temperature range when exposed to ambient air.

These and other advantages and novel features of the present invention, as well as details of an illustrated embodiment thereof, will be more fully understood from the following description and drawings.

DETAILED DESCRIPTION OF THE INVENTION

Figure 1:
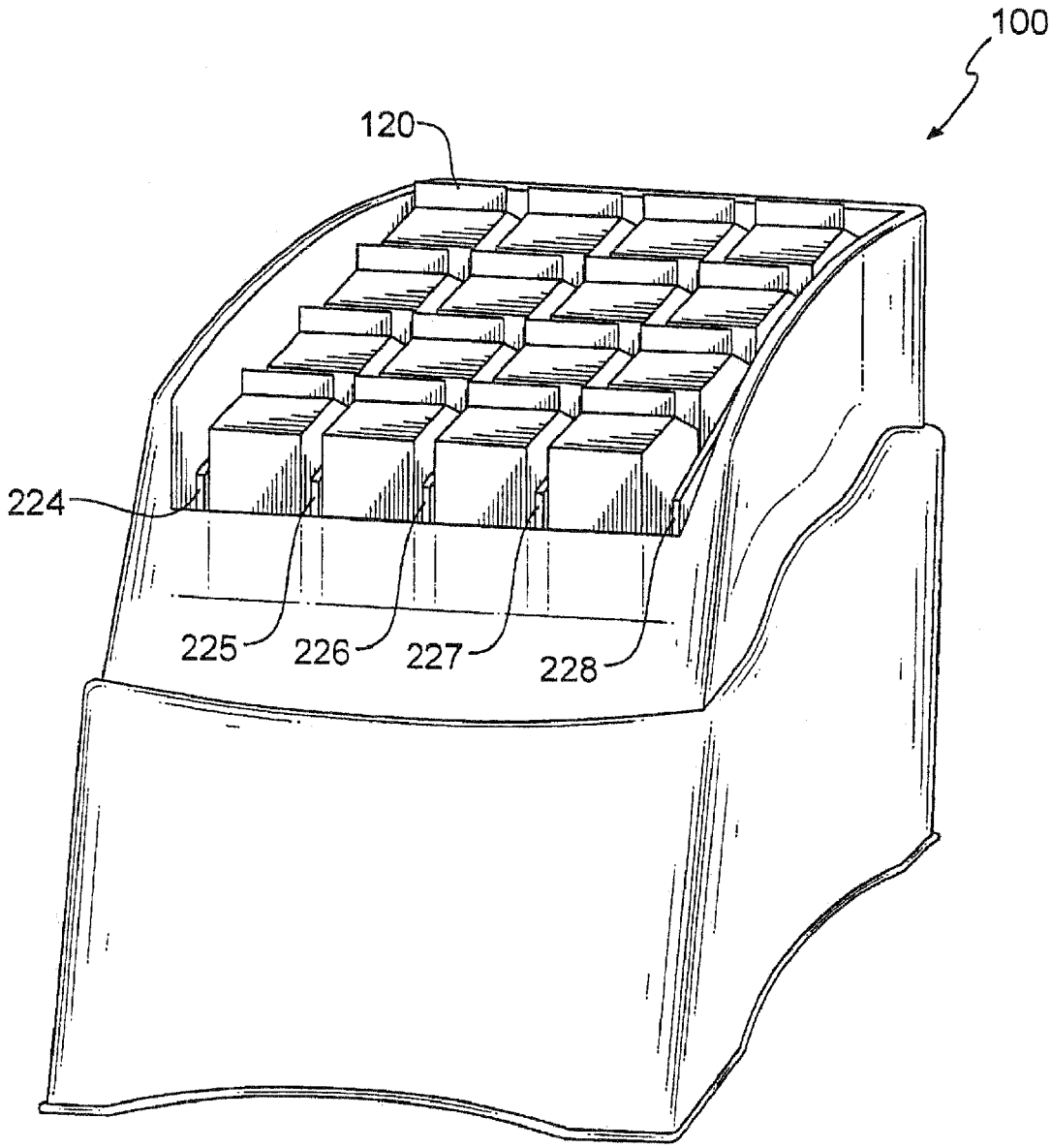
FIG. 1 is a schematic illustration of a three-dimensional view of an exemplary embodiment of a system for storing a product in a thermally stabilized state, in accordance with various aspects of the present invention.

FIG. 1 is a schematic illustration of a three-dimensional view of an exemplary embodiment of a system 100 for storing a product in a thermally stabilized state, in accordance with various aspects of the present invention. As used herein, thermally stabilized means remaining within a predefined temperature range over time. The system 100 comprises a display container which can hold a product 120 (e.g., a plurality of juice cartons containing juice). The system 100 is open on top such that the juice cartons 120 may be easily removed without having to open a door or a lid of any kind. For example, the system 100 may be stationed at a check-out counter in a store. A consumer, who is checking out, may see the display container of juice cartons and pull a juice carton out of the display container, on impulse, in order to purchase the carton of juice. The juice inside of the carton is cool (e.g., the system 100 maintains the juice at 40+/−2 degrees Fahrenheit) and is ready for consumption. Marketing studies have shown that a potential customer is more likely to purchase such a product at a check-out counter if he does not have to open a lid or door and if the product is ready for immediate consumption. Various embodiments of the present invention may be used to thermally stabilize products of various types and shapes including, for example, rectangular cartons of juice, cylindrical cans of soda, cylindrical bottles of water, rectangular cartons of milk, or any other type of perishable or non-perishable, consumable product to be kept cooled or heated.

Figure 2:
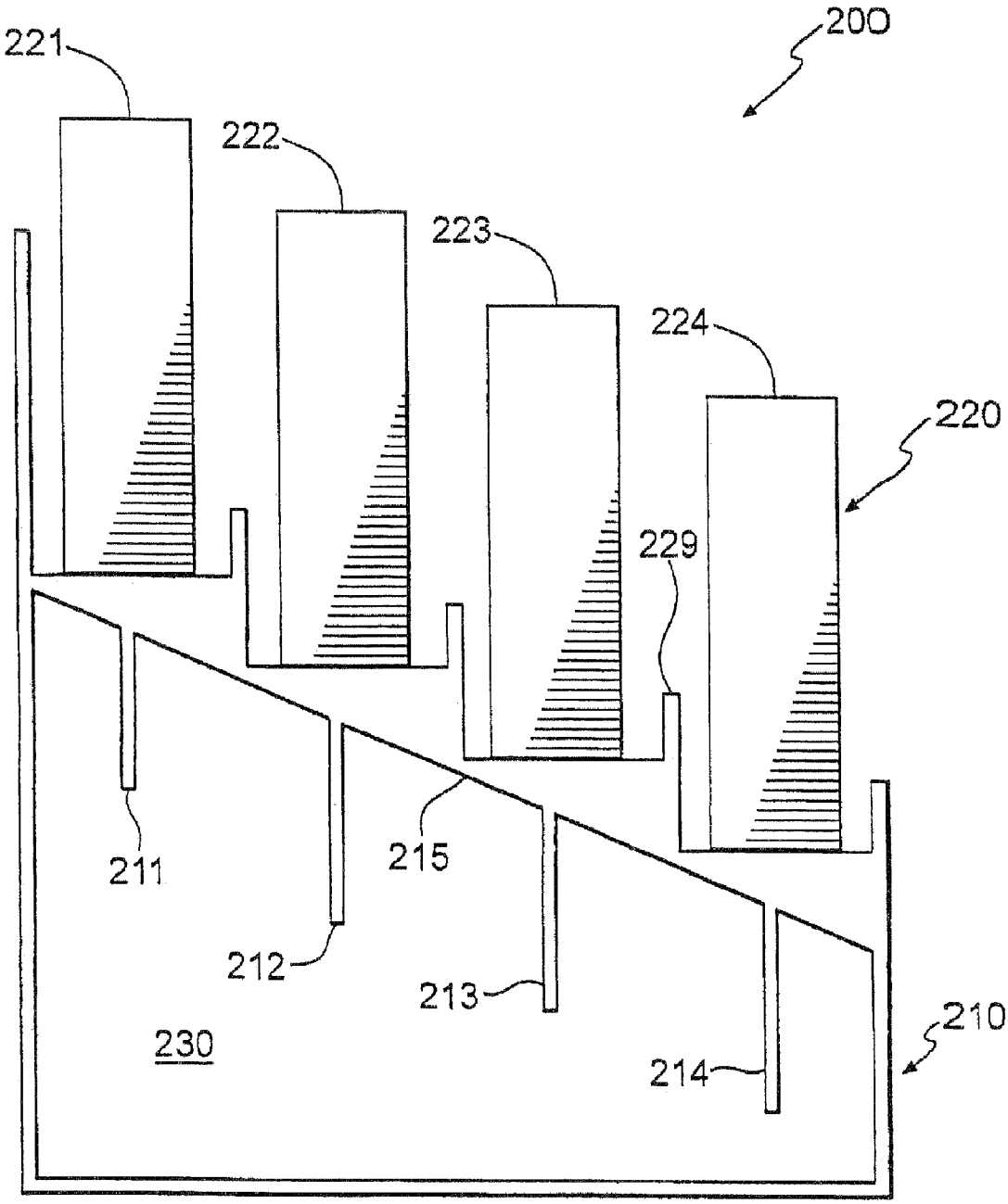
FIG. 2 is a schematic illustration of a cross-sectional side view of an exemplary embodiment of a thermally-conductive structure used in the system of FIG. 1 for storing a product in a thermally stabilized state, in accordance with various aspects of the present invention.

FIG. 2 is a schematic illustration of a cross-sectional side view of an exemplary embodiment of a thermally-conductive structure 200 used in the system 100 of FIG. 1 for storing a product in a thermally stabilized state, in accordance with various aspects of the present invention. As defined herein, thermally-conductive means having the thermal energy transmission properties to achieve the desired temperature stabilization of the product. The thermally-conductive structure 200 includes an enclosed volume 210 and an open section 220. In accordance with an embodiment of the present invention, the thermally-conductive structure 200 is made of aluminum. Other thermally-conductive materials are possible as well, in accordance with various other embodiments of the present invention, such as, for example, copper or stainless steel. The structure 200 may be an assembled structure, a molded structure, or a cast structure, in accordance with various embodiments of the present invention.

In accordance with an embodiment of the present invention, the thermally-conductive structure 200 includes a plurality of thermally-conductive fins 211–214. In accordance with other embodiments of the present invention, the fins 211–214 may instead comprise thermally-conductive plates, walls, or probes. The fins (e.g., 211–214) extend into the interior space 230 of the enclosed volume 210 from a thermally-conductive boundary 215 which is between the open section 220 and the enclosed volume 210.

In accordance with an embodiment of the present invention, the thermally-conductive structure 200 includes a plurality of thermally-conductive holders (e.g., 221–224) extending from the thermally-conductive boundary 215 between the enclosed volume 210 and the open section 220. The holders 221–224 may include fins, plates, or walls, in accordance with various embodiments of the present invention. The holders may be, for example, rectangular or curved in shape. The holders 221–224 are used to store individual units of a product (e.g. cartons of juice) such that the individual units are in thermal contact (e.g., in physical contact) with the holders 221–224. The fin 224 can also be seen in FIG. 1. In general, the fins form a matrix of thermally-conductive holders for the product 120. Other fins (e.g., 225–228) can be seen in FIG. 1 as well. When product is placed in the open section 220, at least one fin is in thermal contact with at least one side of each unit of the product.

In accordance with the embodiment of FIG. 2, thermally-conductive lips (e.g., 229) are also provided as part of the thermally-conductive structure and provide additional thermal contact with the fronts and backs of the product 120 when the product 120 is stored in the open section 220 between the fins, and help to hold the product 120 in place.

Figure 3:
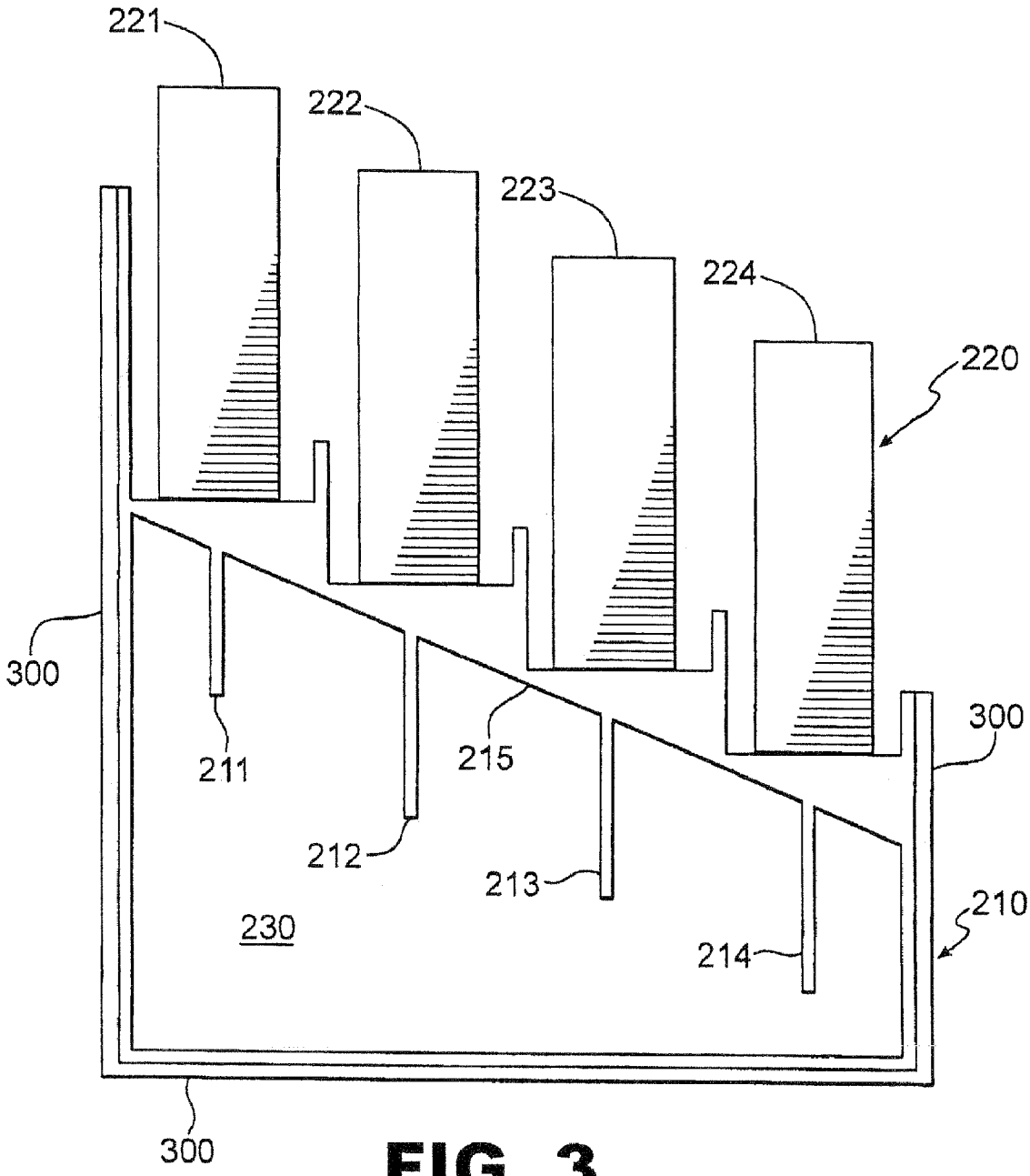
FIG. 3 is a schematic illustration of a cross-sectional side view of the exemplary embodiment of the thermally-conductive structure of FIG. 2 and further including a thermally-insulating material, in accordance with various aspects of the present invention.

FIG. 3 is a schematic illustration of a cross-sectional side view of the exemplary embodiment of the thermally-conductive structure 200 of FIG. 2 and further including a thermally-insulating material 300, in accordance with various aspects of the present invention. The thermally-insulating material 300 covers the outer surface of the thermally-conductive structure 200 and serves to help stabilize the temperature of the thermally-conductive structure 200. The thermally-insulating material may comprise styrofoam or some other type of insulating material which is resistant to the transfer of thermal energy and help to achieve the desired thermal stabilization of the product.

Figure 4:
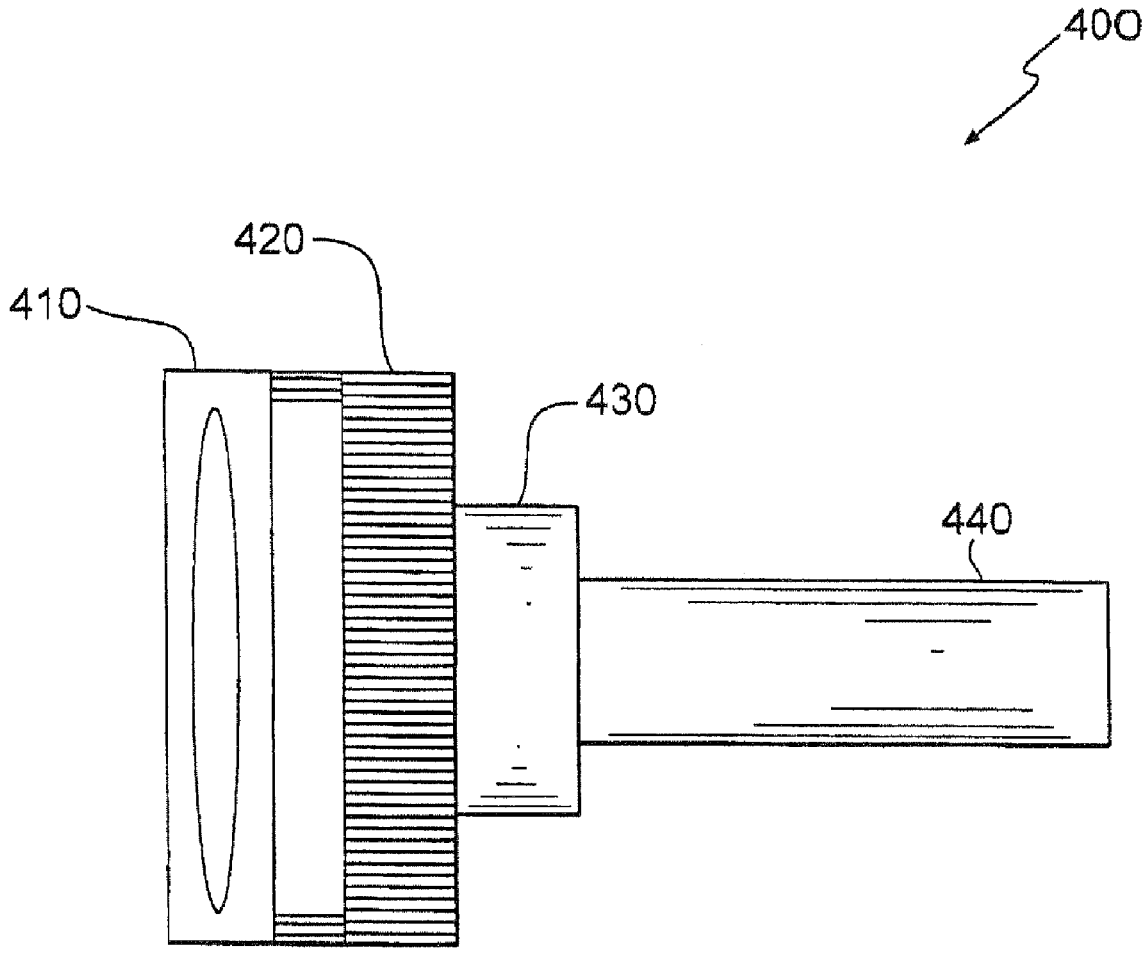
FIG. 4 is a schematic illustration of a side-view of an exemplary embodiment of a thermo-electric device used in the system of FIG. 1 for storing a product in a thermally stabilized state, in accordance with various aspects of the present invention.

FIG. 4 is a schematic illustration of a side-view of an exemplary embodiment of a thermo-electric device 400 used in the system 100 of FIG. 1 for storing a product in a thermally stabilized state, in accordance with various aspects of the present invention. The thermo-electric device 400 comprises a fan 410, a heat-sink 420, a Peltier-effect unit 430, and a thermally-conductive probe 440. In general, when electrical power is applied to the thermo-electric device 400 thermal energy is transferred from one side of the thermo-electric device 400 to the other as a result of the Peltier effect. As a result, the probe 440 decreases (or increases) in temperature. See U.S. Pat. No. 5,544,489, which is incorporated herein by reference, for more details on such a thermo-electric device. In accordance with an embodiment of the present invention, two thermo-electric devices 400 are used in the system 100.

Figure 5:
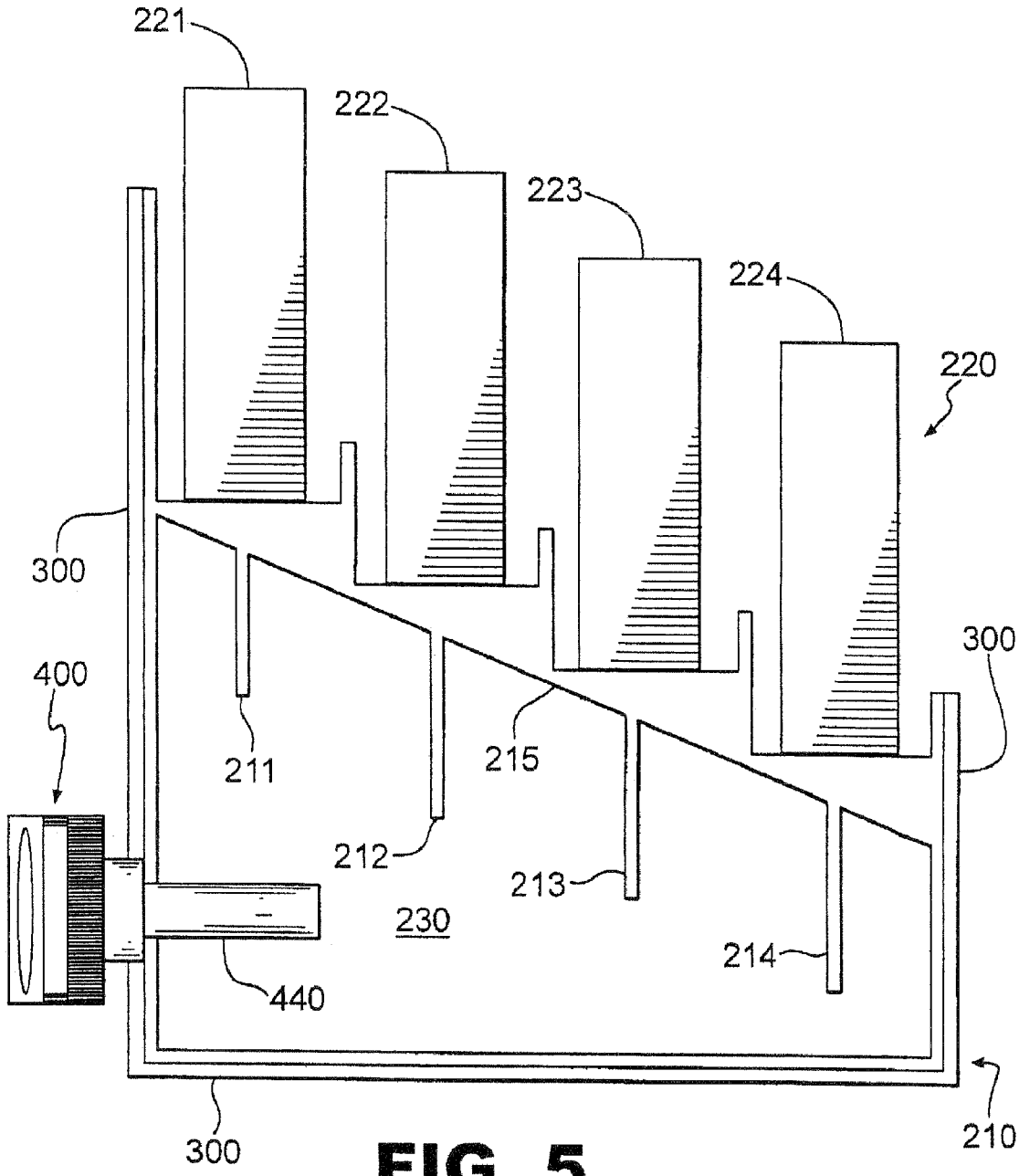
FIG. 5 is a schematic illustration of a cross-sectional side view of the exemplary embodiment of FIG. 3 and further including the thermo-electric device of FIG. 4, in accordance with various aspects of the present invention.

FIG. 5 is a schematic illustration of a cross-sectional side view of the exemplary embodiment of FIG. 3 and further including the thermo-electric device 400 of FIG. 4, in accordance with various aspects of the present invention.

The probe 440 of the thermo-electric device 400 extends from a cold side (or, alternatively, a hot side) of the Peltier-effect unit 430, through a wall of the enclosed volume 210 of the thermally-conductive structure 200, and into an interior space 230 that is enclosed by the enclosed volume 210.

Figure 6:
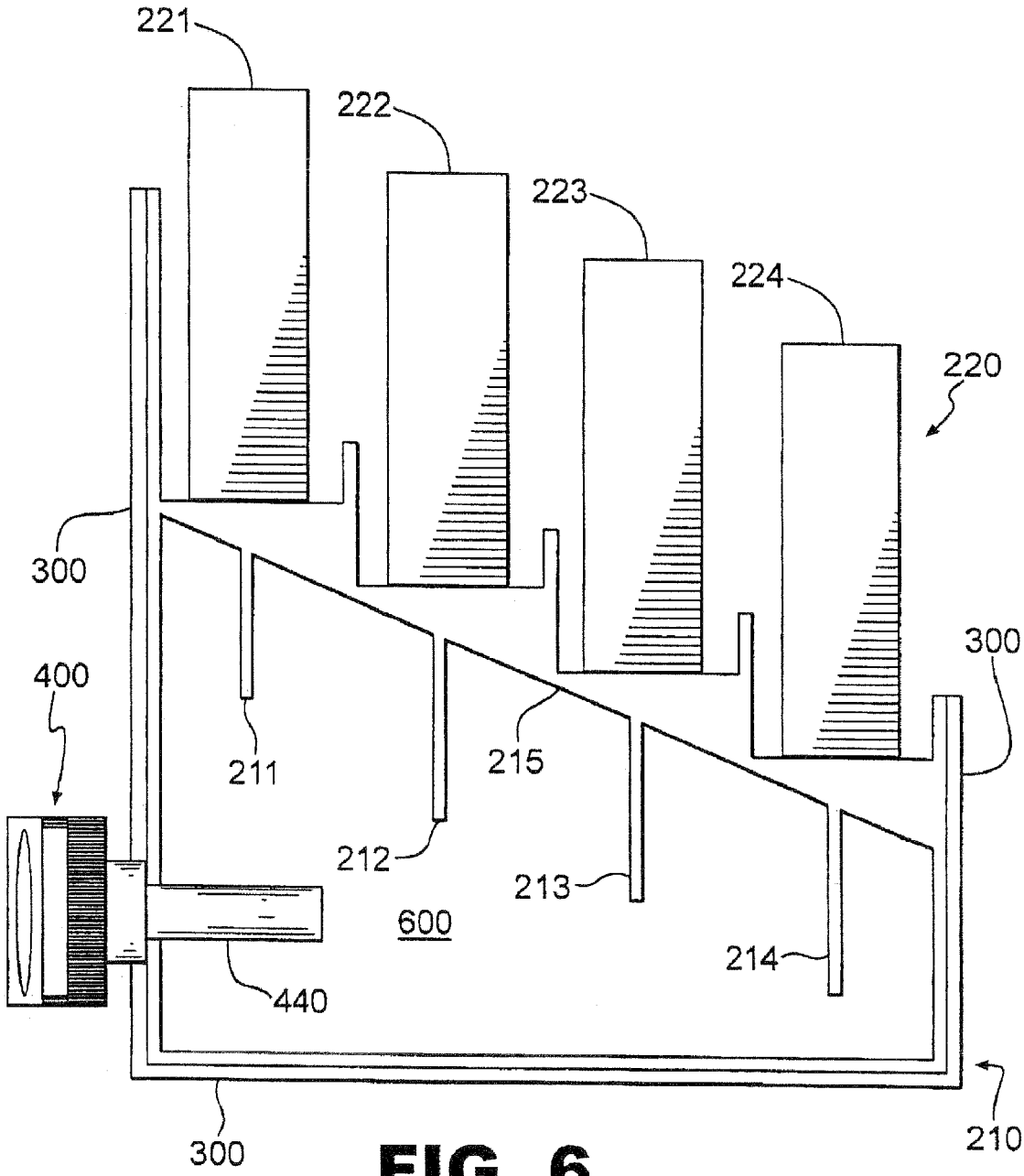
FIG. 6 is a schematic illustration of a cross-sectional side view of the exemplary embodiment of FIG. 5 and further including a fluid enclosed in an enclosed volume of the thermally-conductive structure of FIG. 2, in accordance with various aspects of the present invention.

FIG. 6 is a schematic illustration of a cross-sectional side view of the exemplary embodiment of FIG. 5 and further including a fluid 600 enclosed in the interior space 230 of the enclosed volume 210 of the thermally-conductive structure 200 of FIG. 2, in accordance with various aspects of the present invention. In accordance with an embodiment of the present invention, the fluid 600 is a mixture of water and alcohol. The alcohol helps prevent the fluid 600 from freezing when exposed to the cold probe 440. However, any type of fluid that does not freeze during operation of the system 100 may be used (e.g., glycol). The hole or entry way through which the probe 440 comes through a wall of the thermally-conductive structure 200 is sealed such that the fluid 600 does not leak out of the space 230 of the interior of the enclosed volume 210 of the thermally-conductive structure 200. The fluid 600 serves as a thermal mass to, for example, suck thermal energy away from the thermally-conductive structure 200. In the system 100 of FIG. 1, approximately 2 quarts of fluid 600 is used.

Figure 7:
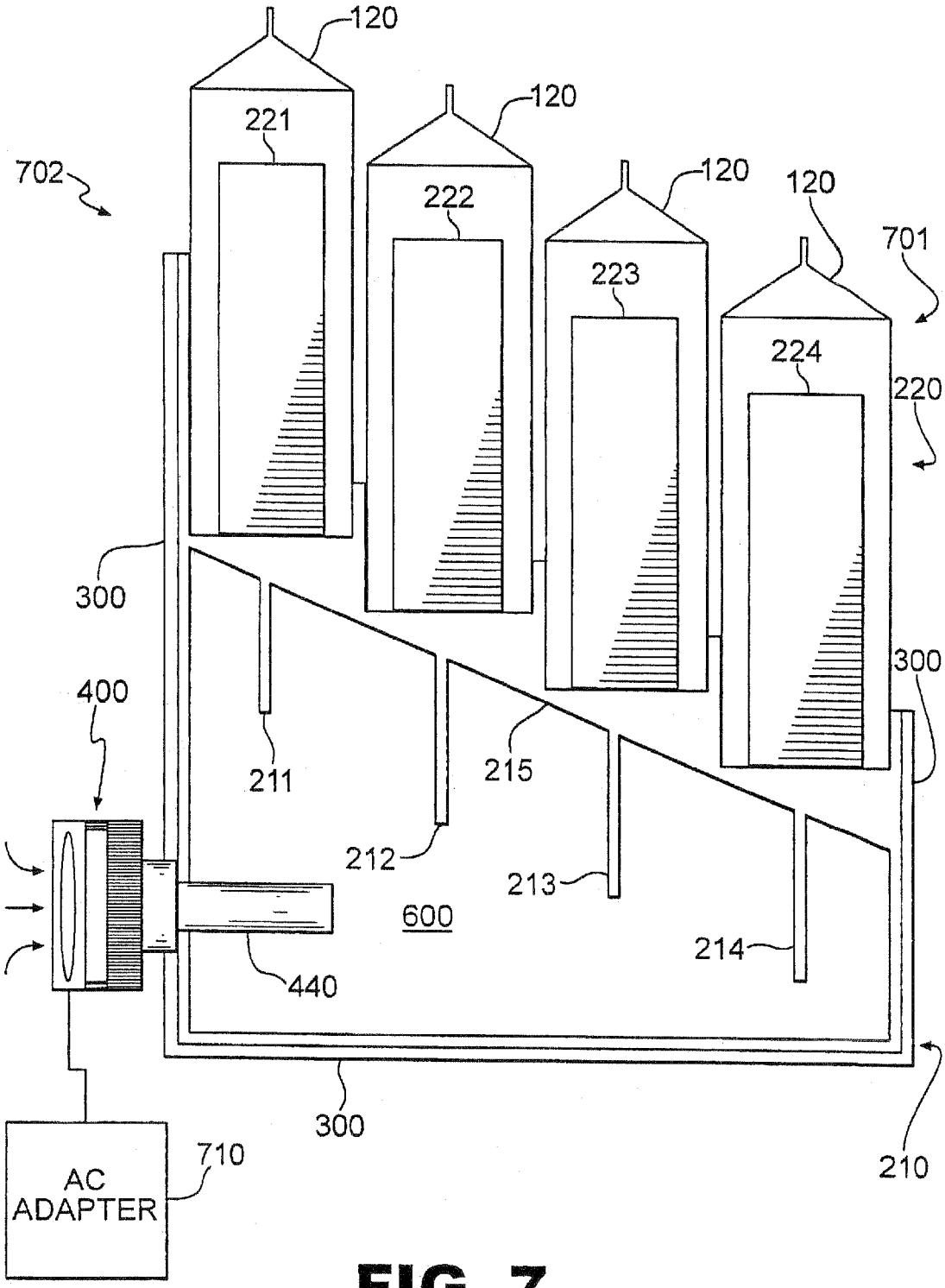
FIG. 7 is a schematic illustration of a cross-sectional side view of the exemplary embodiment of FIG. 6 and further including product being stored in an open section of the thermally-conductive structure of FIG. 2, in accordance with various aspects of the present invention.

FIG. 7 is a schematic illustration of a cross-sectional side view of the exemplary embodiment of FIG. 6 and further including product 120 being stored in the open section 220 of the thermally-conductive structure 200 of FIG. 2, in accordance with various aspects of the present invention. In FIG. 7, as in FIG. 1, the product 120 comprises cartons of juice. The product 120, when placed in the open section 220 of the thermally-conductive structure 200, makes physical contact with at least the fins (e.g., 221–228) and a surface of the thermally-conductive boundary 215 between the enclosed volume 210 and the open section 220. In accordance with an embodiment of the present invention, the thermally-conductive boundary 215 is stair-stepped such that the product 120 progressively raises up from the front 701 of the system 100 to the back 702 of the system 100 as shown in FIG. 1 and FIG. 7. As an alternative, the boundary 215 may be a smooth, angled surface, allowing product at the back of the system to slide forward to a lower level when product at the front of the system is removed.

During operation, the thermo-electric device 400 is powered up by, for example, at least one AC adapter or transformer 710 providing 12 VDC (i.e., DC powered). As the thermo-electric device 400 operates, the temperature of the probe 440 decreases (or increases). As a result, the temperature of the thermally-conductive fluid 600 also decreases (increases). Since certain interior surfaces (i.e., certain interior portions) of the thermally-conductive structure 200 (i.e., the enclosed section of the structure) are in physical contact with the fluid 600, the temperature of the thermally-conductive structure 200 also decreases (increases). The product 120 is in thermal contact with parts of the open section 220 (i.e., parts external to the enclosed section) of the thermally-conductive structure 200. In accordance with an embodiment of the present invention, the system 100 consumes approximately 100 watts of electrical power.

In accordance with an embodiment of the present invention, the thermally-conductive structure 200 is pre-conditioned (i.e., cooled) to be within a pre-determined temperature range (e.g., 40+/−2 degrees Fahrenheit) before the product 120 is stored in the open section 220. Also, the product 120 is pre-conditioned (i.e., cooled) to be within a pre-determined temperature range (e.g., 38+/−1 degrees Fahrenheit) before being placed within the open section 220. When the product 120 is stored within the open section 220, the system 100 maintains the temperature of the product 120 to be within the pre-defined temperature range (i.e., thermally stabilizes the product) even though the product 120 is exposed to ambient air (e.g., at 72 degrees Fahrenheit) since the section 220 is open. In this way, the product 120 stays chilled, for example, and consumers are able to easily grab the product 120 out of the system 100, without having to open a lid or door of any kind.

In general, the temperature stabilizing process of the system 100 works as follows for cooling. Thermal energy (i.e. heat) flows from the ambient air to the product 120 to the thermally-conductive structure 200, to the thermally-conductive fluid 600, to the thermally-conductive probe 440, through the Peltier-effect unit 430, and to the heat-sink 420. The fan 410 blows ambient air onto the heat-sink 420 to help dissipate heat away from the heat-sink 420. In accordance with an embodiment of the present invention, the system 100 is able to thermally stabilize the product 120 within a temperature range of, for example, 40+/−2 degrees Fahrenheit when the temperature of the ambient air is anywhere between 67 and 73 degrees Fahrenheit.

Figure 8:
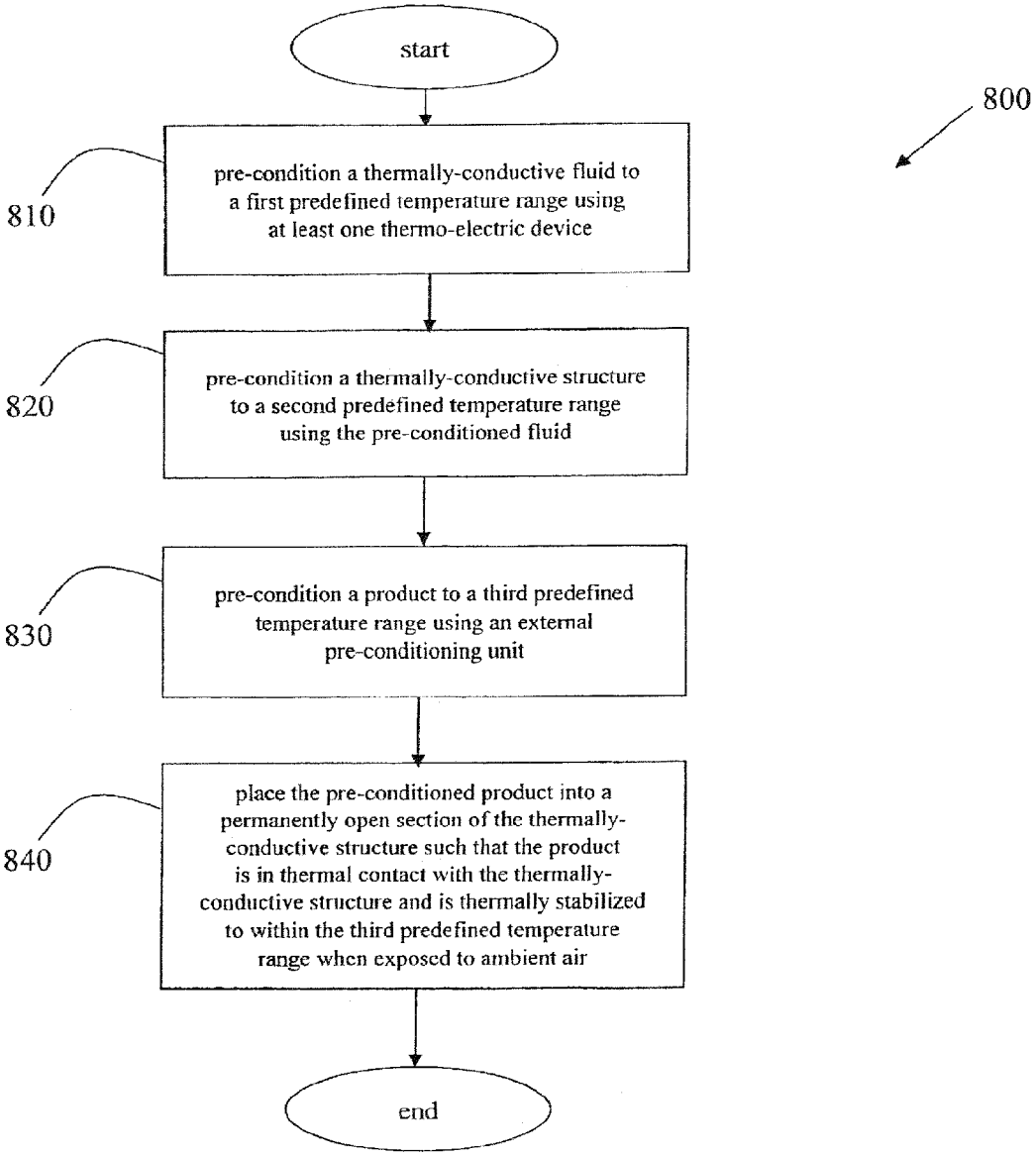
FIG. 8 is a flowchart of a first exemplary embodiment of a method to thermally stabilize a product using the system of FIG. 1, in accordance with various aspects of the present invention.

FIG. 8 is a flowchart of a first exemplary embodiment of a method 800 to thermally stabilize a product using the system 100 of FIG. 1, in accordance with various aspects of the present invention. In step 810, a thermally-conductive fluid (e.g., 600) is pre-conditioned (e.g., cooled or heated) to a first predefined temperature range using at least one thermo-electric device (e.g., 400). In step 820, a thermally-conductive structure (e.g., 200) is pre-conditioned (i.e., cooled or heated) to a second predefined temperature range using the pre-conditioned fluid. In step 830, a product (e.g., 120) is pre-conditioned (e.g., cooled or heated) to a third predefined temperature range (e.g., 40+/−2 degrees Fahrenheit) using an external pre-conditioning unit (e.g., a standard refrigeration unit or oven unit). In step 840, the pre-conditioned product is placed into a permanently open section of the thermally-conductive structure and is thermally stabilized to within the third predefined temperature range when exposed to ambient air (e.g., at 72 degrees Fahrenheit). The first, second, and third pre-defined temperature ranges may all be the same or may be different. Typically, however, the first predefined temperature range is lower than the second which is lower than the third for a cooling process, in accordance with certain embodiments of the present invention.

For example, the system 100 of FIG. 1 may be powered up and allowed to cool down over time such that the thermally-conductive fluid 600 stabilizes to a first temperature range and the thermally-conductive structure 200 stabilizes to a second temperature range. In accordance with an embodiment of the present invention, it may take up to 24 hours for the system 100 to cool down from an ambient temperature and stabilize. The product 120 may be cartons of orange juice which have been kept refrigerated in a standard refrigeration unit and then are placed in the open section 220 of the system 100 when the system 100 has cooled down and stabilized.

Figure 9:
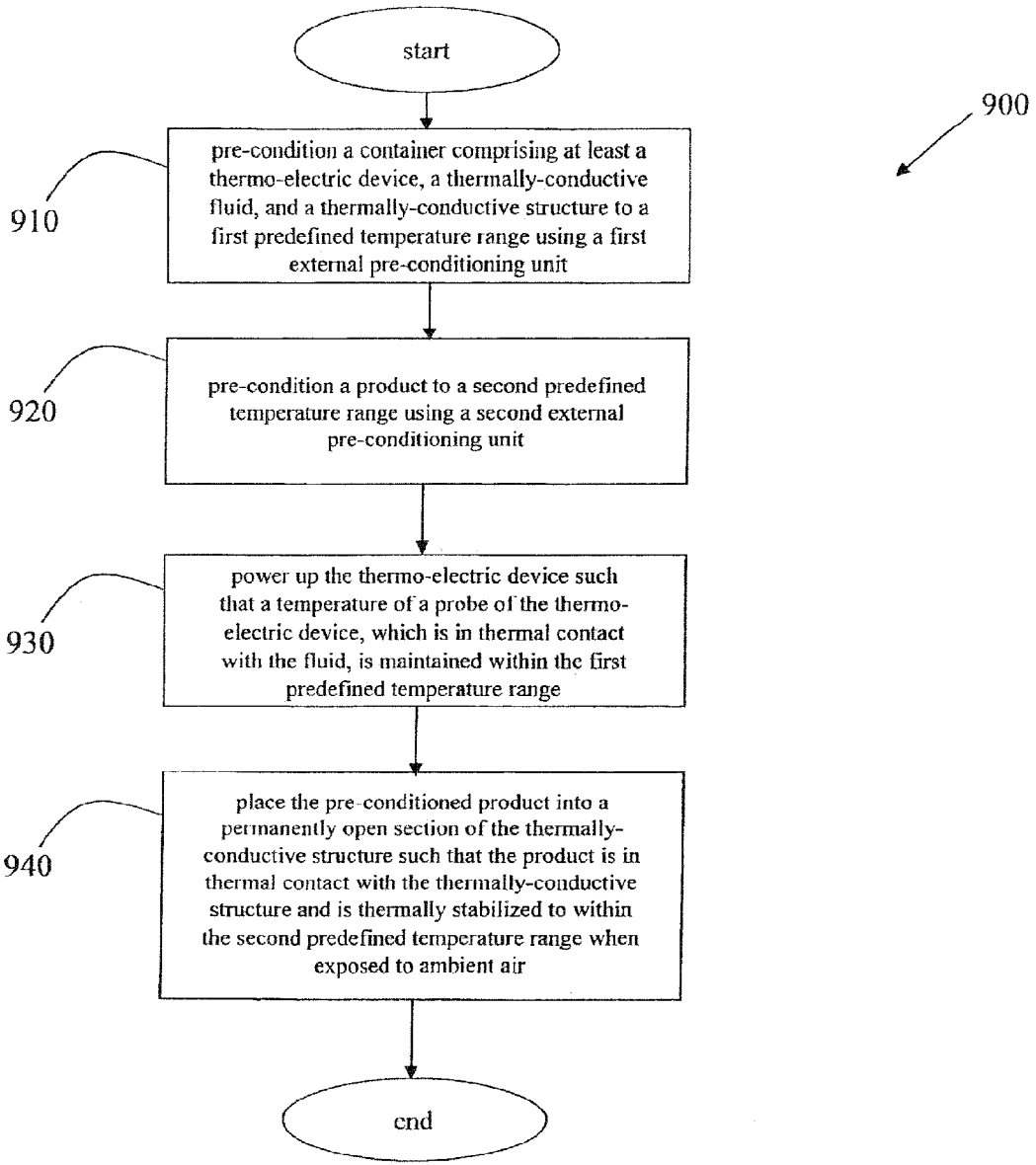
FIG. 9 is a flowchart of a second exemplary embodiment of a method to thermally stabilize a product using the system of FIG. 1, in accordance with various aspects of the present invention.

FIG. 9 is a flowchart of a second exemplary embodiment of a method 900 to thermally stabilize a product using the system 100 of FIG. 1, in accordance with various aspects of the present invention. In step 910, a container comprising at least a thermo-electric device (e.g., 400), a thermally-conductive fluid (e.g., 600) and a thermally-conductive structure (e.g., 200) are pre-conditioned (e.g., cooled) to a first predefined temperature range (e.g., 35+/−2 degrees Fahrenheit) using a first external pre-conditioning unit (e.g., a standard freezer unit). In step 920, a product (e.g., 120) is pre-conditioned (e.g., cooled) to a second predefined temperature range (e.g., 40+/−2 degrees Fahrenheit) using a second external pre-conditioning unit (e.g., a standard refrigeration unit). In step 930, the thermo-electric device is powered up such that a temperature of a probe of the thermo-electric device, which is in thermal contact with the fluid, is maintained within said first predefined temperature range. In step 940, the pre-conditioned product is placed into a permanently open section of the thermally-conductive structure and is thermally stabilized to within the second predefined temperature range when exposed to ambient air (e.g., at 72 degrees Fahrenheit). The first and second predefined temperature ranges may be the same or may be different. Typically, however, for cooling, the first predefined temperature range is lower than the second, in accordance with certain embodiments of the present invention.

As an example, the system 100 may be placed in a freezer to cool the whole system down to a first pre-defined temperature range. Such pre-conditioning of the system 100 may be much faster than that of the method 800 of FIG. 8 (e.g., several hours). Again, the product 120 may be cartons of orange juice which have been kept refrigerated in a standard refrigeration unit and then are placed in the open section 220 of the system 100 when the system 100 has cooled down and stabilized. By powering up the thermo-electric device 400 of the system 100, the product 120 stays thermally stabilized to within the second predefined temperature range.

In accordance with an embodiment of the present invention, the thermo-electric device 400 is on all of the time in order to thermally stabilize the product 120. However, as an option, a thermostat connected to a temperature sensor could be incorporated into the system 100 such that a temperature of some part of the system 100 or product 120 is monitored. The thermo-electric device 400 could be turned on and off based on pre-defined temperature thresholds. If more than one thermo-electric device 400 is being used in the system 100, then all or any of the thermo-electric devices 400 could be controlled to turn on and off in order to better thermally stabilize the product. For example, modulating between 50% and 100% could result in a narrower temperature band.

In summary, embodiments of the present invention provide a system for storing a product in a thermally stabilized state. The system includes a thermally-conductive probe which is connected to a thermo-electric device and is used to cool a thermally-conductive fluid which is sealed within the system. The thermally-conductive fluid cools an aluminum thermally-conductive structure which is designed to hold product, such as cartons of juice. As a result, the product is maintained within a desired temperature range, even though the product is exposed to the surrounding ambient air having a temperature which is higher than the desired temperature range of the product. No fluids have to be pumped throughout the system and no complex refrigeration techniques are used.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A system for storing a product in a thermally stabilized state, said system comprising:

a thermally-conductive structure having at least an enclosed volume and an open section, and wherein said open section is configured to store at least one unit of said product as said product is exposed to ambient air;

a thermally-conductive fluid sealed within said enclosed volume and being in thermal contact with said enclosed volume;

at least one thermo-electric device; and at least one thermally-conductive probe extending from said at least one thermo-electric device and into said fluid, said probe providing a thermally-conductive path between said fluid and said thermo-electric device.

2. The system of claim 1 further comprising a thermally-insulating material covering at least one outer surface of said thermally-conductive structure.

3. The system of claim 1 wherein said at least one thermo-electric device cools said at least one thermally-conductive probe via the Peltier effect.

4. The system of claim 1 wherein said at least one thermo-electric device increases a temperature of said at least one thermally-conductive probe via the Peltier effect.

5. The system of claim 1 wherein said thermally-conductive structure comprises aluminum.

6. The system of claim 1 wherein said at least one thermally-conductive probe comprises aluminum.

7. The system of claim 1 wherein said thermally-conductive structure comprises an assembled structure.

8. The system of claim 1 wherein said thermally-conductive structure comprises a molded structure.

9. The system of claim 1 wherein said thermally-conductive structure comprises a cast structure.

10. The system of claim 1 wherein said thermally-conductive structure includes a plurality of at least one of thermally-conductive fins, plates, walls, and probes extending into said fluid from a thermally-conductive boundary between said open section and said enclosed volume.

11. The system of claim 1 wherein said thermally-conductive structure includes a plurality of thermally-conductive holders extending from a thermally-conductive boundary between said enclosed volume and said open section, such that each unit of said product may be stored in one of said holders and be in thermal contact with said holder.

12. The system of claim 1 wherein said thermally-conductive structure includes a plurality of thermally-conductive holders extending from a thermally-conductive boundary between said enclosed volume and said open section, such that each unit of said product may be stored in one of said holders and be in physical contact with said holder.

13. The system of claim 1 wherein said thermally-conductive structure includes a plurality of fins, plates, or walls extending from a thermally-conductive boundary between said enclosed volume and said open section, and wherein said fins, plates, or walls form a plurality of thermally-conductive holders for each unit of said product such that at least one of said plurality of thermally-conductive fins, plates, or walls is in thermal contact with at least one side of each unit of said product.

14. The system of claim 1 wherein said thermally-conductive structure includes a plurality of fins, plates, or walls extending from a thermally-conductive boundary between said enclosed volume and said open section, and wherein said fins, plates, or walls form a plurality of thermally-conductive holders for each unit of said product such that at least one of said plurality of thermally-conductive fins, plates, or walls is in physical contact with at least one side of each unit of said product.

15. The system of claim 1 wherein said fluid comprises a mixture of water and alcohol.

16. The system of claim 1 wherein said fluid comprises a mixture that does not freeze during operation of said system.

17. The system of claim 1 wherein said at least one thermo-electric device comprises a Peltier-effect unit, a heat-sink, and a fan.

18. The system of claim 1 wherein said at least one thermo-electric device is DC powered.

19. The system of claim 1 further comprising at least one AC adapter or transformer adapted to provide DC power to said at least one thermo-electric device.

20. The system of claim 1 wherein said product comprises at least one carton of a perishable or a non-perishable product.

21. The system of claim 1 wherein said system thermally stabilizes said product to within a temperature range of 40+/−2 degrees Fahrenheit when said ambient air is at a temperature of between 67 degrees Fahrenheit and 73 degrees Fahrenheit.

22. The system of claim 1 wherein said thermally-conductive structure and said product are each pre-conditioned to a temperature range of 40+/−2 degrees Fahrenheit before said product is stored in said open section of said thermally-conductive structure.

23. A method for thermally stabilizing a product, said method comprising:

pre-conditioning a thermally-conductive fluid to a first predefined temperature range using at least one thermo-electric device;

pre-conditioning a thermally-conductive structure to a second predefined temperature range using said pre-conditioned fluid;

pre-conditioning a product to a third predefined temperature range using an external pre-conditioning unit; and placing said pre-conditioned product into a permanently open section of said thermally-conductive structure such that said product is in thermal contact with said thermally-conductive structure and is thermally stabilized to within said third predefined temperature range when exposed to ambient air.

24. The method of claim 23 wherein said third predefined temperature range is 40+/−2 degrees Fahrenheit.

25. The method of claim 23 wherein said first predefined temperature range is such that said fluid does not freeze.

26. The method of claim 23 wherein said fluid comprises a mixture of water and alcohol.

27. The method of claim 23 wherein said fluid comprises a mixture that does not freeze during operation.

28. The method of claim 23 wherein said thermally-conductive structure comprises at least one of aluminum, copper, and stainless steel.

29. The method of claim 23 wherein said product comprises at least one container of a perishable, consumable fluid.

30. The method of claim 23 wherein said product comprises at least one container of a non-perishable, consumable fluid.

31. The method of claim 23 wherein said at least one thermo-electric device operates based on the Peltier effect.

32. The method of claim 23 wherein said external pre-conditioning unit comprises a refrigeration unit.

33. A method for thermally stabilizing a product, said method comprising:

pre-conditioning a container comprising at least a thermo-electric device, a thermally-conductive fluid, and a thermally-conductive structure to a first predefined temperature range using a first external pre-conditioning unit;

pre-conditioning a product to a second predefined temperature range using a second external pre-conditioning unit;

powering up the thermo-electric device such that a temperature of a probe of the thermo-electric device, which is in thermal contact with the fluid, is maintained within said first predefined temperature range; and placing said pre-conditioned product into a permanently open section of said thermally-conductive structure such that said product is in thermal contact with said thermally-conductive structure and is thermally stabilized to within said second predefined temperature range when exposed to ambient air.

34. The method of claim 33 wherein said second predefined temperature range is 40+/−2 degrees Fahrenheit.

35. The method of claim 33 wherein said first predefined temperature range is such that said fluid does not freeze and is lower than said second predefined temperature range.

36. The method of claim 33 wherein said fluid comprises a mixture of water and alcohol.

37. The method of claim 33 wherein said fluid comprises a mixture that does not freeze during operation.

38. The method of claim 33 wherein said thermally-conductive structure comprises at least one of aluminum, copper, and stainless steel.

39. The method of claim 33 wherein said product comprises at least one container of a perishable, consumable fluid.

40. The method of claim 33 wherein said product comprises at least one container of a non-perishable, consumable fluid.

41. The method of claim 33 wherein said at least one thermo-electric device operates based on the Peltier effect.

42. The method of claim 33 wherein said first external pre-conditioning unit comprises a freezer.

43. The method of claim 33 wherein said second external pre-conditioning unit comprises a refrigeration unit.

44. A system for keeping a product cool, said system comprising:

a first enclosed section of a thermally-conductive structure enclosing a volume;

a second open product storage section of said thermally-conductive structure being exterior to and in thermal contact with said first enclosed section;

a thermally-conductive fluid sealed within said volume of said enclosed section and being in thermal contact with at least a portion of an interior surface of said enclosed section;

at least one thermo-electric device; and at least one thermally-conductive path between said thermo-electric device and said fluid.

45. A method for keeping a product cool, said method comprising:

decreasing a temperature of a thermally-conductive fluid to a first predefined temperature range;

decreasing a temperature of a thermally-conductive structure to a second predefined temperature range;

decreasing a temperature of a product to a third predefined temperature range; and placing said product into an open section of said thermally-conductive structure such that said product is in thermal contact with said thermally-conductive structure and is thermally stabilized to within said third predefined temperature range when exposed to ambient air.

46. A method for keeping a product cool, said method comprising:

decreasing a temperature of a container comprising at least a thermo-electric device, a thermally-conductive fluid, and a thermally-conductive structure to a first predefined temperature range;

decreasing a temperature of a product to a second predefined temperature range;

powering up the thermo-electric device such that a temperature of a member of the thermo-electric device, which is in thermal contact with the fluid, is maintained within said first predefined temperature range; and placing said product into an open section of said thermally-conductive structure such that said product is in thermal contact with said thermally-conductive structure and is thermally stabilized to within said second predefined temperature range when exposed to ambient air.

47. A system for storing a product in a thermally stabilized state, said system comprising:

a thermally-conductive structure having at least an enclosed volume and an open section, and wherein said open section is configured to store at least one unit of said product as said product is exposed to ambient air;

a thermally-conductive fluid sealed within said enclosed volume and being in thermal contact with said enclosed volume;

at least one thermo-electric device; and at least one thermally-conductive probe extending from said at least one thermo-electric device and into said fluid, said probe providing a thermally-conductive path between said fluid and said thermo-electric device, and wherein said thermally-conductive structure includes a plurality of thermally-conductive holders extending from a thermally-conductive boundary between said enclosed volume and said open section, such that each unit of said product may be stored in one of said holders and be in thermal contact with said holder.

48. A system for storing a product in a thermally stabilized state, said system comprising:

a thermally-conductive structure having at least an enclosed volume and an open section, and wherein said open section is configured to store at least one unit of said product as said product is exposed to ambient air;

a thermally-conductive fluid sealed within said enclosed volume and being in thermal contact with said enclosed volume;

at least one thermo-electric device; and at least one thermally-conductive probe extending from said at least one thermo-electric device and into said fluid, said probe providing a thermally-conductive path between said fluid and said thermo-electric device, and wherein said thermally-conductive structure includes a plurality of thermally-conductive holders extending from a thermally-conductive boundary between said enclosed volume and said open section, such that each unit of said product may be stored in one of said holders and be in physical contact with said holder.

49. A system for storing a product in a thermally stabilized state, said system comprising:

a thermally-conductive structure having at least an enclosed volume and an open section, and wherein said open section is configured to store at least one unit of said product as said product is exposed to ambient air;

a thermally-conductive fluid sealed within said enclosed volume and being in thermal contact with said enclosed volume;

at least one thermo-electric device; and at least one thermally-conductive probe extending from said at least one thermo-electric device and into said fluid, said probe providing a thermally-conductive path between said fluid and said thermo-electric device, and wherein said thermally-conductive structure includes a plurality of fins, plates, or walls extending from a thermally-conductive boundary between said enclosed volume and said open section, and wherein said fins, plates, or walls form a plurality of thermally-conductive holders for each unit of said product such that at least one of said plurality of thermally-conductive fins, plates, or walls is in thermal contact with at least one side of each unit of said product.

50. A system for storing a product in a thermally stabilized state, said system comprising:

a thermally-conductive structure having at least an enclosed volume and an open section, and wherein said open section is configured to store at least one unit of said product as said product is exposed to ambient air;

a thermally-conductive fluid sealed within said enclosed volume and being in thermal contact with said enclosed volume;

at least one thermo-electric device; and at least one thermally-conductive probe extending from said at least one thermo-electric device and into said fluid, said probe providing a thermally-conductive path between said fluid and said thermo-electric device, and wherein said thermally-conductive structure includes a plurality of fins, plates, or walls extending from a thermally-conductive boundary between said enclosed volume and said open section, and wherein said fins, plates, or walls form a plurality of thermally-conductive holders for each unit of said product such that at least one of said plurality of thermally-conductive fins, plates, or walls is in physical contact with at least one side of each unit of said product.

* * * * *